US012139879B2

(12) United States Patent
Jamilosa et al.

(10) Patent No.: US 12,139,879 B2
(45) Date of Patent: Nov. 12, 2024

(54) WORK MACHINE DIPPER WITH IMPROVED DIG AND PAYLOAD PERFORMANCE

(71) Applicant: Caterpillar Global Mining LLC, Tucson, AZ (US)

(72) Inventors: James G. Jamilosa, Waipahu, HI (US); Andrew Seungyul Yun, Savoy, IL (US); Jae Beom Park, Savoy, IL (US); Mustafa I. Alsaleh, Dunlap, IL (US); Matthew James Lossmann, Peoria, IL (US)

(73) Assignee: Caterpillar Global Mining LLC, Tucson, AZ (US)

( * ) Notice: Subject to any disclaimer, the term of this patent is extended or adjusted under 35 U.S.C. 154(b) by 398 days.

(21) Appl. No.: 17/140,834

(22) Filed: Jan. 4, 2021

(65) Prior Publication Data

US 2022/0213663 A1 Jul. 7, 2022

(51) Int. Cl.

| | |
|---|---|
| ***E02F 3/407*** | (2006.01) |
| ***E02F 3/30*** | (2006.01) |
| ***E02F 9/28*** | (2006.01) |

(52) U.S. Cl.

CPC ..... *E02F 3/4075* (2013.01); *E02F 3/308* (2013.01); *E02F 9/2825* (2013.01)

(58) Field of Classification Search

CPC ..... E02F 3/308; E02F 3/4075; E02F 9/2825

See application file for complete search history.

(56) References Cited

U.S. PATENT DOCUMENTS

| | | | | |
|---|---|---|---|---|
| 1,603,573 | A * | 10/1926 | Baker | E02F 9/121 212/231 |
| 4,282,664 | A | 8/1981 | Thiele et al. | |
| 5,063,694 | A | 11/1991 | McCreary, Jr. | |
| 7,096,610 | B1 * | 8/2006 | Gilmore | E02F 3/4075 37/445 |
| 8,943,714 | B2 | 2/2015 | Hren | |
| 10,329,734 | B2 | 6/2019 | Garcia-Huidobro Valdivieso | |
| 10,519,621 | B2 | 12/2019 | Feld et al. | |

(Continued)

FOREIGN PATENT DOCUMENTS

| | | |
|---|---|---|
| CN | 103225325 | 5/2016 |
| WO | 9010756 W | 9/1990 |
| WO | 2009010930 W | 1/2009 |

OTHER PUBLICATIONS

Written Opinion and International Search Report for Int'l. Patent Appln. No. PCT/US2021/064326, mailed Apr. 15, 2022 (12 pgs).

*Primary Examiner* — Saul Rodriguez
*Assistant Examiner* — Brendan P Tighe

(57) ABSTRACT

A dipper for a work machine is disclosed. The dipper may have a front cavity wall forming an inlet which defines a vertical inlet plane, a rear cavity wall opposite the front cavity wall forming an outlet which defines an outlet plane, a top cavity wall extending between front and rear cavity walls defining a horizontal top plane, a bottom cavity wall opposite the top cavity wall defining a bottom plane, and two side cavity walls. The two side cavity walls may further extend between the front and rear cavity wall. The outlet plane may be angled relative to the inlet plane, the bottom plane may be angled relative to the top plane, and the outlet plane is perpendicular to the bottom plane.

20 Claims, 5 Drawing Sheets

(56) References Cited

U.S. PATENT DOCUMENTS

| | | | | |
|---|---|---|---|---|
| 2013/0195594 | A1* | 8/2013 | Knuth | E02F 3/4075 414/722 |
| 2015/0345105 | A1 | 12/2015 | Gross | |
| 2017/0254043 | A1 | 9/2017 | Briscoe | |
| 2017/0292242 | A1 | 10/2017 | Hren et al. | |
| 2020/0173278 | A1 | 6/2020 | Gross | |

* cited by examiner

WORK MACHINE DIPPER WITH IMPROVED DIG AND PAYLOAD PERFORMANCE

TECHNICAL FIELD

The present disclosure generally relates to a work machine and, more particularly, relates to a dipper for a work a machine.

BACKGROUND

Excavating shovel dippers or buckets are used in construction to scoop earthen material from horizontal or vertical surfaces. Dippers can be mounted, via a mounting bracket, to work machines like electric rope shovels or excavators. A conventional electric rope shovel has a boom, a dipper handle pivotally connected to a mid-point of the boom, and the dipper pivotally connected at one end of the dipper handle. A cable extends over a pulley at a distal end of the boom and terminates at the end of the dipper handle supporting the dipper. The cable is reeled in or spooled out on a hoist drum being powered by electric, hydraulic, and/or mechanical motors to selectively raise and lower the dipper. The dipper is normally provided with sharp teeth to provide a digging action against the surface being worked and further includes a cavity for collecting the earthen materials to be removed. Once the earther material is received within the dipper, the dipper is usually discharged into a dump truck, onto a conveyor, or merely onto a pile.

Once complexity function in dipper performance is dictated by the environment in which the electric rope shovel is operating. For example, oil sands have proven to be particularly detrimental to dipper performance giving the hard-digging condition found with Devonian geology. Current dippers cannot penetrate well, last long, or fill dump trucks in relatively few passes.

U.S. Pat. No. 5,063,694 describes an excavating dipper for use with power shovels that is fabricated from steel plate and is formed having a separable bottom body member. The plate members forming the side and bottom cavity walls of the bottom body member are reinforced by longitudinal and transverse girth ribs.

While effective, there remains a need for improved dipper designs for work machines used in high wear applications, such as construction and mining.

SUMMARY

In accordance with one aspect of the present disclosure, a dipper for a work machine is disclosed. The dipper may have a front cavity wall forming an inlet which defines a vertical inlet plane, a rear cavity wall opposite the front cavity wall forming an outlet which defines an outlet plane, a top cavity wall extending between front and rear cavity walls defining a horizontal top plane, a bottom cavity wall opposite the top cavity wall defining a bottom plane, and two side cavity walls connected between the top cavity wall and the bottom cavity wall. The two side cavity walls may further extend between the front and rear cavity wall. The outlet plane may be angled relative to the inlet plane, the bottom pane may be angled relative to the top plane, and the outlet plane is perpendicular to the bottom plane.

In accordance with another aspect of the present disclosure, a work machine is disclosed. The work machine may include a base supported on a ground surface, a revolving frame connected to the base that is rotatable about an axis, a boom that is pivotally connected to the revolving frame, a boom handle that is pivotally connected to the boom, and a dipper coupled to the boom handle. The dipper may have a front cavity wall forming an inlet which defines a vertical inlet plane, a rear cavity wall opposite the front cavity wall forming an outlet which defines an outlet plane, a top cavity wall extending between front and rear cavity walls defining a horizontal top plane, a bottom cavity wall opposite the top cavity wall defining a bottom plane, and two side cavity walls connected between the top cavity wall and the bottom cavity wall. The two side cavity walls may further extend between the front and rear cavity wall. The outlet plane may be angled relative to the inlet plane, the bottom plane may be angled relative to the top plane, and the outlet plane is perpendicular to the bottom plane.

In accordance with a further aspect of the present disclosure, a method of making a dipper is disclosed. The method may include providing a front cavity wall that defines an inlet which may itself define a vertical inlet plane, positioning a rear cavity wall which may define an outlet, opposite the front cavity wall, and extending a top cavity wall defining a horizontal top plane between the front cavity wall and the rear cavity wall. The method may further include extending a bottom cavity wall, defining a bottom plane, opposite the top cavity wall before connecting two side cavity walls between the top cavity wall and the bottom cavity wall. The two side cavity walls may further extend between the front cavity wall and the rear cavity wall. The outlet plane may be angled relative to the inlet plane, the bottom plane may be angled relative to the top plane, and the outlet plane may be perpendicular to the bottom plane. The method further including connecting a lip to a bottom surface of each of the two side cavity walls and a front surface of the bottom cavity wall, the lip extending outwardly from the inlet in a direction away from the outlet, and the lip having an inner surface which may define a lip plane that may be parallel with the horizontal top plane.

These and other aspects and features of the present disclosure will be more readily understood when read in conjunction with the accompanying drawings.

DETAILED DESCRIPTION

Figure 1:
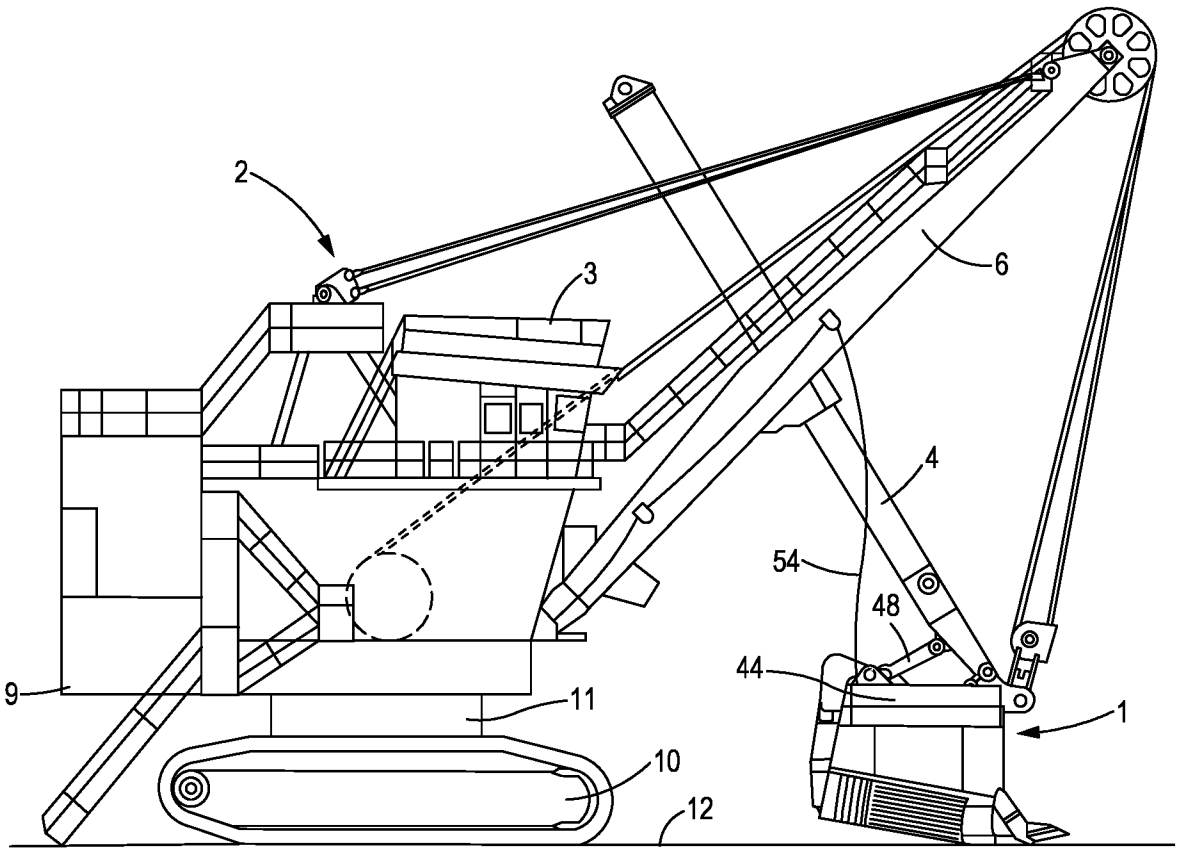
FIG. 1 is a diagrammatic illustration of a work machine having a dipper.

Referring to FIG. 1, a dipper 1 is attached to a work machine 2. The work machine 2 may embody a fixed or mobile machine that performs some type of operation associated with an industry such as mining, construction, farming, transportation, or any other industry known in the art. For example, the work machine 2 may be an earth moving machine such as an electric rope shovel, as shown, or a backhoe, an excavator, a dozer, a loader, a motor grader, or any other earth moving machine. Work machine 2 may include a boom handle 4 and the dipper 1 (e.g., bucket, etc.) supported by a boom 6. The dipper 1 is coupled to the boom handle 4, moving in more than one direction along with the boom handle 4. The dipper 1 is configured to hold earth and other materials that are loaded into the dipper 1 by the action of the boom handle 4. The boom handle 4 is configured to apply a force to the dipper 1, pushing the dipper 1 into a surface 8 (shown in FIG. 3) (i.e. a bank of material such as overburden, ore, or other earthen material to be mined or moved and referred to collectively as "mining material"). The dipper 1 is forced into the bank by the force of the boom handle 4, digging into the surface 8 and filling the dipper 1 with mining material.

The work machine may further include a revolving frame 9 connected to and supported by a base 10. The revolving frame 9 is rotatable about an axis (not shown) relative to the base 10 by a rotating assembly 11. The base is supported on a ground surface 12. The revolving frame may further include a cabin 13, and the boom 6 being pivotally connected to the revolving frame 9. The boom handle 4 may also be pivotally connected to the boom.

Although the disclosure is shown and described by way of example with reference to a work machine 2, the disclosure is also applicable for use with any machine or vehicle that includes a dipper or bucket for digging and/or transporting material, such as excavators, etc., all of which are intended to within the scope of the disclosure.

Figure 2:
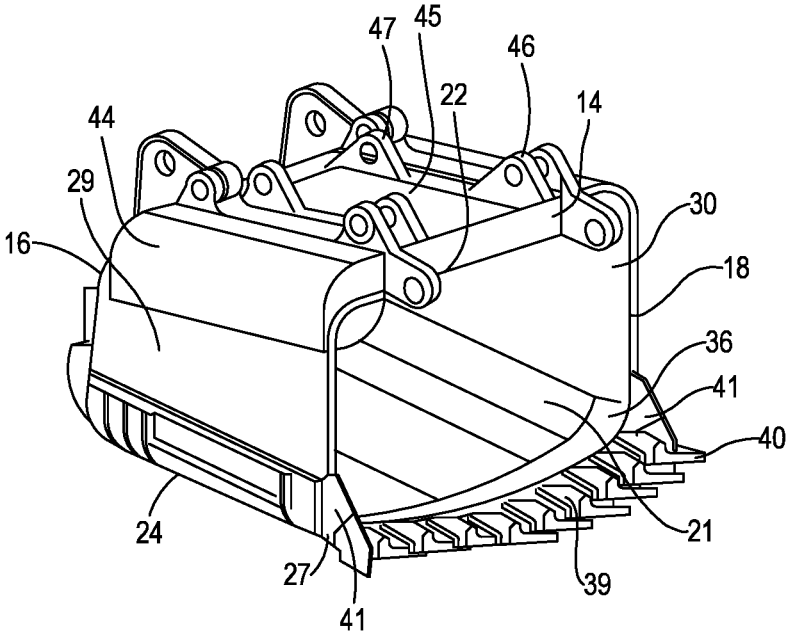
FIG. 2 is a perspective view of an exemplary dipper, in accordance with the present disclosure.
Figure 3:
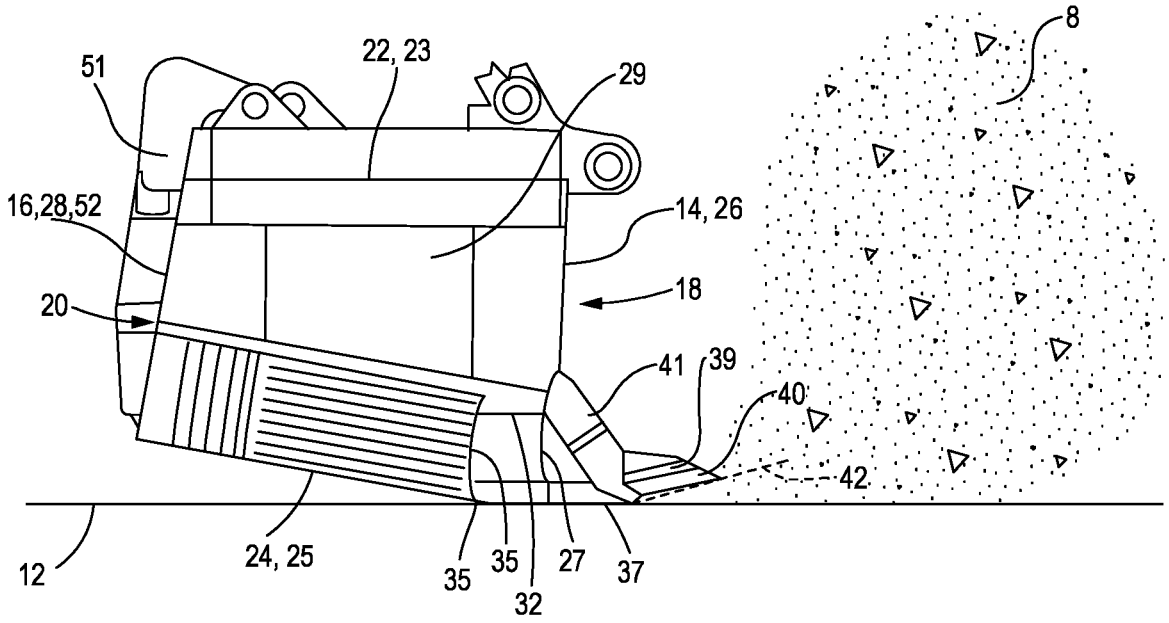
FIG. 3 is a left side view of the dipper of FIG. 2, in accordance with the present disclosure.

Referring to FIGS. 2-5, the dipper 1 is shown, according to an exemplary embodiment. The dipper 1 includes a front cavity wall 14 and a rear cavity wall 16. The front cavity wall 14 defines an inlet 18, through which the dipper 1 is filled, and the rear cavity wall 16 defines an outlet 20, through which the dipper 1 is emptied. The inlet 16 and the outlet 20 define a cavity 21. As best shown in FIG. 3, the dipper 1 further includes a top cavity wall 22 defining a substantially horizontal top plane 23, and a bottom cavity wall 24, opposite the top cavity wall 22, defining a bottom plane 25. The bottom cavity wall 24, in one exemplary embodiment, may be grated or lattice framed, and include a replaceable liner. The top cavity wall 22 extends between the front cavity wall 14 and the rear cavity wall 16, and the bottom cavity wall 24 may extend from the rear cavity wall 16 in a direction towards the inlet 18, or an inlet plane 26. In a further exemplary embodiment, the bottom cavity wall 24 extends from the rear cavity wall 16 to the lip 27 (discussed below). The inlet 18, as shown in its side profile in FIG. 3, defines the substantially vertical inlet plane 26, and the outlet 20 defines an outlet plane 28. A first side cavity wall 29 and an opposite second side cavity wall 30 are connected between the top cavity wall 22 and the bottom cavity wall 24 and extend between the from the front cavity wall 14 and rear cavity wall 16.

In one exemplary embodiment, the cavity 21 is defined by the inlet 18 and the outlet 20, and is further defined by the front cavity wall 14, rear cavity wall 16, top cavity wall 22, bottom cavity wall 24, and the first and second side cavity walls 29, 30. In another exemplary embodiment, in a side profile of the dipper 1 as shown in FIG. 3, the cavity 21 is defined by the top plane 23, bottom plane 25, inlet plane 26, and the outlet plane 28. In this embodiment, the side profile shape of the cavity 21 may be a quadrilateral with no parallel sides, as the inlet plane 26 is not parallel to the outlet plane 28, and the top plane 23 is not parallel to the bottom plane 24. Further is this embodiment, the bottom plane 25 is perpendicular to the outlet plane 28.

The inlet 18 may have a larger width than height, forming a substantially rectangular shape that may have rounded corners. Similarly, the outlet may have a larger width than height, forming a substantially rectangular shape that may have rounded corners. The inlet 18 may have a width to height ratio of 1.8-2.2, and the outlet a width to height ratio of 2.1-2.6. A width to length body length ratio between 1.3-1.7 may exist between the top plane 23 and the inlet plane 26. The difference in width to height ratios between the inlet and outlet 18, 20, along with the 5-10 degrees angled bottom plane (discussed below), gives the cavity 21 formed between the inlet 18 and outlet 20 a funnel shape.

Shown in FIG. 3, the dipper 1 is shown in an exemplary digging configuration. A digging configuration is when the boom handle 4 is configured to apply a force to the dipper 1, pushing the dipper 1 into the surface 8. In this configuration, the top pane 23 is substantially parallel to the ground surface 12. The bottom plane 25 is angled relative to the top plane 23. In one exemplary embodiment, the bottom pane is angled 5-10 degrees relative to the plane and is angled downwards in a direction towards the inlet plane 26, or the inlet 14.

Further, the inlet plane 26, defined by the front cavity wall 14, may be substantially vertical, and perpendicular to the top cavity wall 22, or the top plane 23. The outlet plane 28, defined by the rear cavity wall 16, extends from the top cavity wall 22 to the bottom cavity wall 24, and may be angled relative to the inlet plane 26, or the front cavity wall 14 extending from the top cavity wall 22 in a direction away from the inlet plane 26. The outlet plane 28 being perpendicular to the bottom plane 25.

As shown in FIGS. 2-3, the dipper may further comprise the lip 27 coupled to a bottom surface 32, 33 of each of the first and second side cavity walls 29, 30 and a front surface 35 of the bottom cavity wall 24. The lip 37 may extend outwardly in a direction away from the outlet 20 and have an inner surface 36 defining a lip plane 37. The lip plane 37 is arranged substantially parallel with the top plane 23. In the digging configuration shown in FIG. 3, the lip plane 37 may be substantially parallel with the ground surface 12. The lip may comprise a plurality of adaptors 39, where each adaptor of the plurality of adaptors is configured to hold a pierce digging tooth 40. In one exemplary embodiment, the number of adaptors comprising the plurality of adaptors is between 7-10, but any number of adaptors suitable to conduct a digging operation may be used. The lip 27 may further comprise two lip protectors 41, on opposite ends of the lip 37, that are attach to the lip 27 and may engage with the front cavity wall 14 and extend away from the inlet 18.

Best shown in FIG. 3, the plurality of adaptors 39 define an adaptor plane 42. In one exemplary embodiment, the adaptor plane 42 points in an upward direction, between 5-15 degrees upwards relative to the lip plane 37, away from the inlet 18. In a further exemplary embodiment, the plurality of adaptors 39 can be mounted in reverse to define the adaptor plane in a downwards direction (not shown), between 5-15 degrees downwards relative to the lip plane 37, and away from the inlet 18.

The dipper 1 may further include a reinforced section 44, as shown in FIGS. 1-2. This reinforced section 44 may be relatively thick such as 1 to 18 inches, and an extension of, or coupled to, the top cavity wall 22, allowing for greater structural support of the dipper 1. On top of the dipper 1, connected to the reinforced section 44, or a top surface 45 of the top cavity wall 22, may be a first and second set of mounting brackets 46, 47. The first set of mounting brackets 46 is used for connecting to the broom handle 4, and the second set of mounting brackets 47 is for connecting to a boom lever 48. The boom lever 48 is configured to pivot the dipper 1, relative to the boom handle 4, and the boom handle 4 is configured to pivot relative to the boom 6. The boom handle 4 and the boom 6 and configured to move the dipper 1 from the digging configuration shown in FIG. 3 to an unloading configuration (not shown), in which the dipper is rotated so that the top plane 23 is substantially perpendicular to the ground surface 12. In this configuration a rear door 50 of the dipper 1, will be open, and any mining materials located in the cavity 21 can flow out of the outlet 20.

Figure 5:
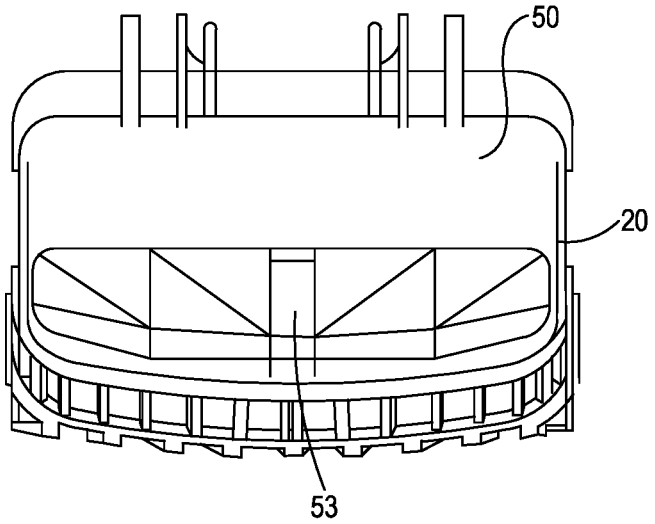
FIG. 5 is a front view of the dipper of FIG. 2, in accordance with the present disclosure.

The rear door 50, as shown in FIG. 5, may be pivotally mounted to the dipper 1 by a door bracket 51 attached to the top surface 45 of the top cavity wall 22, or the reinforced section 44. The rear door 50 is configured to move from a closed position to an open position to open the outlet 20, and to move from an open position to a closed position to close the outlet 20. The rear door 50 further defining a rear door plane 52 when in the closed position. The rear door plane is angled relative to the inlet plane 26 when is the closed position.

Figure 4:
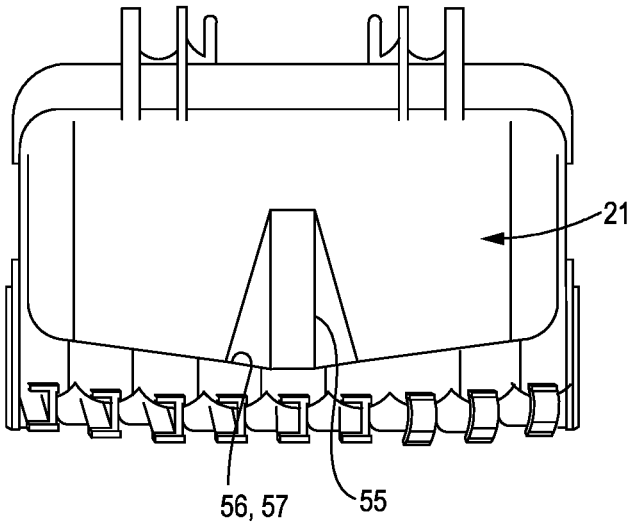
FIG. 4 is a rear view of the dipper of FIG. 2, in accordance with the present disclosure.

The rear door may further comprise a latching mechanism 53, as shown in FIG. 5, configured to lock the rear door when in the closed position. The latching mechanism 53 may be unlocked by a pull string 54, or hydraulic cable (not shown), or electric latching mechanism with an electric wire (not shown), in order to allow the rear door 50 to be moved to the open position. The latching mechanism 53 may extend through the rear door 50 through an aperture (not shown) and may be at least partially housed inside of the cavity 21. In order to protect the latching mechanism 53, the latching mechanism 53 may further include a protective cover 55, as best shown in FIG. 4. The protective cover 55 may have a bottom surface 56 defining a latching mechanism plane 57, and the latching mechanism plane 57 may be substantially parallel to the bottom plane 25.

INDUSTRIAL APPLICABILITY

In general, the teachings of the present disclosure may find applicability in many industries including, but not limited to, electric rope shovels. More specifically, the teachings of the present disclosure may find applicability in any industry using dippers, or shovels, in a digging operation, such as, but not limit to, mining, excavating, agriculture, construction, and the like.

Figure 6:
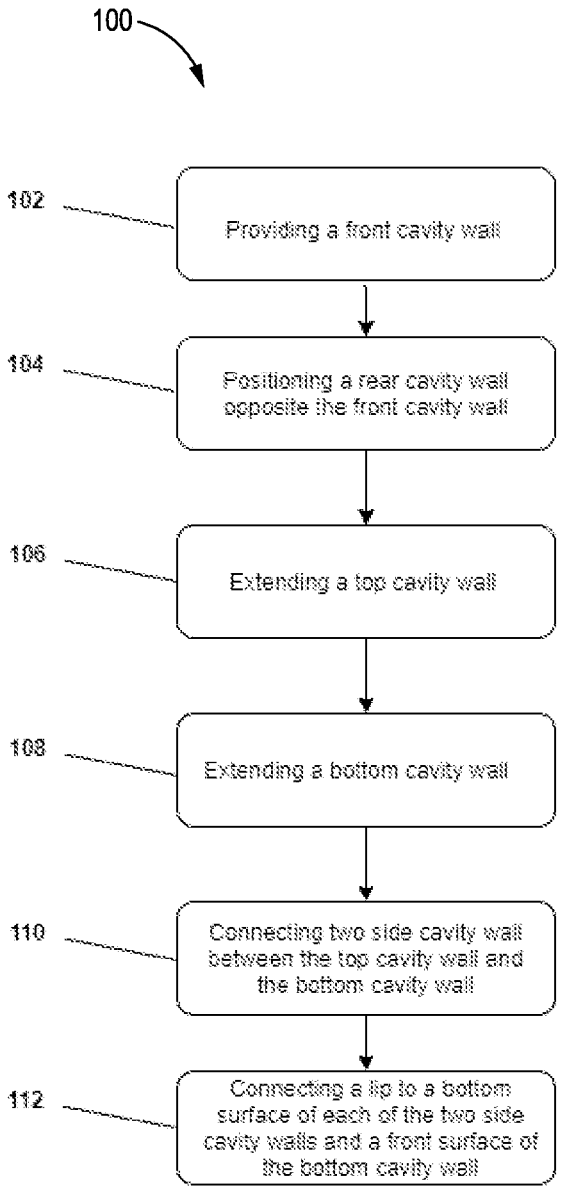
FIG. 6 is a flow chart of a series of steps that may be involved in the making of a dipper, in accordance with aspects of the present disclosure.

Turning now to FIG. 6, with continued reference to FIGS. 1-5, a flowchart illustrating an exemplary process 100 for making a dipper 1 is disclosed. At block 100, a front cavity wall 14 defining an inlet 18, and the inlet 18 defining a substantially vertical inlet plane 26, is provided. At block 104, a rear cavity wall 16 is positioned opposite the front cavity wall 14, the rear cavity wall 16 may define an outlet 20, and the outlet 20 may define an outlet plane 28. In block 106, a top cavity wall 22 is then extended between the front cavity wall 14 and the rear cavity wall 16. The top cavity wall may define a substantially horizontal top plane. A bottom cavity wall 24 opposite the top cavity wall 22, in block 108, is then extended from the rear cavity wall 16 towards the inlet 18, and further defines a bottom plane 25. The method may then include, at block 110, connecting two side cavity walls 29, 30 between the top cavity wall 22 and the bottom cavity wall 24, the two cavity walls 29, 30 may further extend between the front cavity wall 14 and the rear cavity wall 16.

In the resulting dipper 1 from the process 100, the outlet plane 28 may be angled relative to its inlet plane 26, and the bottom plane 25 may be angled relative to the top plane 23. Further, the outlet plane 28 may be perpendicular to its bottom plane 25, creating a quadrilateral side profile with no parallel sides which allows for better digging without dragging the bottom of the dipper 1 when the top plane 23 is positioned parallel with a ground surface 12.

The dipper's 1 inlet 18 may further have a wider width than height, allowing for a more efficient pass volume during the digging operation. Similarly, the outlet 20 may have a wider width than height, with a larger width to height ratio, along with a tapered bottom angled downwards and extending from the outlet 20 towards the inlet 18, creating a funnel shaped cavity 21 that allows for the more efficient pass volume. The more efficient pass loading may include 3-5 pass loadings for a 400 Ton truck.

As shown in block 112, the process of making the dipper 1 may further include connecting a lip 27 to a bottom surface 32, 33 of the side cavity walls 29, 30, and a front surface 35 of the bottom cavity wall 24. The lip 27 may define a lip plane 37 that is arranged substantially parallel with the top plane 23 of the dipper 1 during the digging operation. To improve the efficiency of the dipper 1 and allow for the more efficient pass loadings, the lip 27 may further include a plurality of adaptors 39 that are angled in an upward direction relative to the lip plane 37. These angled adaptors allow for more efficient digging action as the adaptors each include a pierce digging tooth 40 that will cut through the mining material when the dipper 1 is rotated up and through the mining material, during the digging action, as they are pointed in the direction of travel of the dipper 1 during this maneuver.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A dipper having an inlet and an outlet defining a cavity, the dipper comprising:

a front cavity wall defining the inlet, the inlet defining a substantially vertical inlet plane;

a rear cavity wall opposite the front cavity wall defining the outlet, the outlet defining an outlet plane, and the outlet plane being angled relative to the inlet plane;

a top cavity wall defining a substantially horizontal top plane, the top cavity wall extending between the front cavity wall and the rear cavity wall;

a bottom cavity wall opposite the top cavity wall, the entire bottom cavity wall lying in the same plane, the bottom cavity wall extending from the rear cavity wall towards the inlet plane, the bottom plane being angled relative to the top plane, and the outlet plane is perpendicular to the bottom plane; and two side cavity walls connected between the top cavity wall and the bottom cavity wall and extending between the front cavity wall and the rear cavity wall, wherein the bottom plane is angled downwards towards the inlet plane such that a height of the inlet is greater than a height of the outlet, thereby giving the cavity a funnel shape as the cavity extends from the inlet to the outlet.

2. The dipper of claim 1, in which the bottom plane is angled 5-10 degrees relative to the to the top plane.

3. The dipper of claim 1, further comprising a lip coupled to a bottom surface of each of the two side cavity walls and a front surface of the bottom cavity wall, and extending outwardly in a direction away from the outlet, the lip having an inner surface defining a lip plane that is arranged substantially parallel with the substantially horizontal top plane.

4. The dipper of claim 3, in which the lip further comprises a plurality of adaptors, each adaptor of the plurality of adaptors configured to hold a pierce digging tooth.

5. The dipper of claim 4, in which the adaptors define an adaptor plane, the adaptor plane pointing in an upward direction 5-15 degrees relative to the lip plane.

6. The dipper of claim 4, in which the two side cavity walls are parallel.

7. The dipper of claim 6, in which the top cavity wall and bottom cavity wall are parallel thereby providing the inlet and outlet in rectangular shapes with rounded corners.

8. The dipper of claim 1, further comprising a rear door pivotally mounted by a door bracket attached on the top cavity wall, the rear door configured to move from a closed position to an open position to open the outlet, to move from an open position to a closed position to close the outlet, the rear door defining a rear door plane when in the closed position, and the rear door plane being angled relative to the substantially vertical inlet plane in the closed position.

9. The dipper of claim 8, in which the door further comprises a latching mechanism configured to lock the rear door when in the closed position, the latching mechanism extending into a cavity of the dipper formed between the inlet and the outlet, the latching mechanism having a protective cover that has a bottom surface defining a latching mechanism plane, and the latching mechanism plane being parallel to the bottom plane.

10. The dipper of claim 1, in which the outlet has 2.1-2.6 width to height ratio.

11. The dipper of claim 10, in which the inlet has a 1.8 to 2.2 width to height ratio, causing a cavity formed between the inlet and outlet to be funnel shaped.

12. The dipper of claim 1, in which the bottom cavity wall is lattice framed and has a replaceable liner.

13. A work machine, comprising:

a base configured to be supported on a ground surface;

a revolving frame coupled to the base and rotatable about an axis;

a boom pivotally coupled to the revolving frame;

a boom handle pivotally coupled to the boom;

a dipper coupled to the coupled to the boom handle, the dipper having an inlet and outlet defining a cavity, the dipper further comprising:

a front cavity wall defining the inlet, the inlet defining a substantially vertical inlet plane, a rear cavity wall opposite the front cavity wall defining the outlet, the outlet defining an outlet plane, a top cavity wall defining a substantially horizontal top plane, the top cavity wall extending between the front cavity wall and the rear cavity wall;

a bottom cavity wall opposite the top cavity wall, the entire bottom cavity wall lying in the same plane, the bottom cavity wall extending from the rear cavity wall towards the inlet; and two side cavity walls connected between the top cavity wall and the bottom cavity wall and extending between the front cavity wall and the rear cavity wall, in which the outlet plane is angled relative to the inlet plane, the bottom plane is angled relative to the top plane, and the outlet plane is perpendicular to the bottom plane, wherein the bottom plane is angled downwards towards the inlet plane such that a height of the inlet is greater than a height of the outlet, thereby giving the cavity a funnel shape as the cavity extends from the inlet to the outlet.

14. The work machine of claim 13, the dipper further comprising a lip coupled to a bottom surface of each of the two side cavity walls and a front surface of the bottom cavity wall, and extending in a direction away from the outlet, the lip having an inner surface defining a lip plane that is arranged substantially parallel with the substantially horizontal top plane.

15. The work machine of claim 14, in which the substantially horizontal top surface and the lip plane are configured to be parallel to the ground surface during a digging operation.

16. The work machine of claim 15, in which the dipper further comprises a plurality of adaptors, the plurality of adaptors defining an adaptor plane, and the adaptor plane is configured to rise 5-15 degrees above the lip plane during the digging operation.

17. A method of making a dipper, the method comprising:

providing a front cavity wall defining an inlet, the inlet defining a substantially vertical inlet plane;

positioning a rear cavity wall opposite the front cavity wall, the rear cavity wall defining an outlet, the outlet defining an outlet plane;

extending a top cavity wall defining a substantially horizontal top plane between the front cavity wall and the rear cavity wall;

extending a bottom cavity wall opposite the top cavity wall from the rear cavity wall towards the inlet, the entire bottom cavity wall lying in the same plane; and connecting two side cavity walls between the top cavity wall and the bottom cavity wall, the two side cavity walls further extending between the front cavity wall and the rear cavity wall, in which the outlet plane is angled relative to the inlet plane, the bottom plane is angled relative to the top plane, and the outlet plane is perpendicular to the bottom plane, wherein the bottom plane is angled downwards towards the inlet plane such that a height of the inlet is greater than a height of the outlet, thereby giving the cavity a funnel shape as the cavity extends from the inlet to the outlet; and connecting a lip to a bottom surface of each of the two side cavity walls and a front surface of the bottom cavity wall, the lip extending outwardly from the inlet in a direction away from the outlet, and the lip having an inner surface defining a lip plane that is arranged substantially parallel with the substantially horizontal top plane.

18. The method of claim 17, further including providing the two side cavity walls to be parallel to each other and the top cavity wall and bottom cavity wall to be parallel to each other so that the inlet and outlet are provided in rectangular shapes with rounded corners.

19. The method of claim 17, further including providing the lip with two protective covers that engage with the front cavity wall.

20. The method of claim 17, further including providing a plurality of adaptors configured to hold a pierce digging tooth with the plurality of adaptors defining an adaptor plane, and angling the adaptor plane in an upward direction relative to the lip plane.

* * * * *